United States Patent [19]

Strom-Olsen et al.

[11] Patent Number: 5,027,886

[45] Date of Patent: Jul. 2, 1991

[54] APPARATUS AND METHOD FOR FABRICATION OF METALLIC FIBERS HAVING A SMALL CROSS SECTION

[75] Inventors: John O. Strom-Olsen, Montreal; Piotr Z. Rudkowski, Pierrfond, both of Canada

[73] Assignee: Pitney Bowes Inc., Stamford, Conn.

[21] Appl. No.: 552,289

[22] Filed: Jul. 12, 1990

[51] Int. Cl.[5] ..... B22D 11/06

[52] U.S. Cl. ..... 164/463; 164/423

[58] Field of Search ..... 164/423, 429, 463, 479

[56] References Cited

U.S. PATENT DOCUMENTS

| | | | |
|---|---|---|---|
| Re. 32,427 | 5/1987 | Gregor et al. . | |
| 3,812,901 | 5/1974 | Stewart et al. . | |
| 4,157,729 | 6/1979 | Patton et al. | 164/423 |
| 4,523,626 | 6/1985 | Masumoto et al. . | |
| 4,562,878 | 1/1986 | Lewis | 164/463 |
| 4,913,220 | 4/1990 | Dickson | 164/463 |

*Primary Examiner*—Kuang Y. Lin

*Attorney, Agent, or Firm*—Peter Vrahotes; Melvin J. Scolnick; David E. Pitchenik

[57] ABSTRACT

The instant invention is concerned with the casting of metal fibers, preferably ferrous fibers, by the melt extraction technique. The metal to be cast as a fiber is in the form of a rod which is brought into contact with a spinning wheel having a tapered perimeter. The rod is heated by electromagnetic induction by a specially designed, slightly curved spiral coil. The coil is shaped to focus the heat at, or close to, the tip of the rod so to induce a meniscus. The rod is fed the through an opening in a guide that acts as a heat sink to carry away excess heat and prevent the rod from melting except at its tip. The spinning wheel is placed in contact with the melted portion of the rod and forms the fibers as it is rotated.

16 Claims, 2 Drawing Sheets

APPARATUS AND METHOD FOR FABRICATION OF METALLIC FIBERS HAVING A SMALL CROSS SECTION

BACKGROUND OF THE INVENTION

The unauthorized taking of merchandise has long been a problem for retail stores. Various efforts have been made to prevent such unauthorized taking, commonly referred to as "shoplifting". Picard devised an electronic article surveillance system of the electromagnetic type as disclosed in French patent application no. 763,681 published in 1934. The Picard system included a transmitter, a receiver and a ferromagnetic marker. The transmitter would create an electromagnetic field in an interrogation zone, normally between two gates each containing a transmitter and a receiver, and the ferromagnetic marker would have the characteristic of reacting to the electromagnetic field to transmit a signal. This signal would be received by the receivers of the gates and thus detection would be achieved. Many attempts have been made to fabricate ferromagnetic markers that can be readily detected without the need of generating strong fields. In U.S. Pat. No. 4,568,921 issued to Pokalski, Feb. 4, 1987, a marker is disclosed wherein a ferromagnetic wire is incorporated in a marker. U.S. Pat. No. 32,427 to Gregor, May 26, 1987, discloses a large number of a ferromagnetic materials that can be used in a marker. The use of ferromagnetic fibers having a small cross section is disclosed in U.S. Patent application Ser. No. 290,547, assigned to the assignee of the instant patent application. In patent application Ser. No. 290,547, the advantages of the use of a ferromagnetic fiber is disclosed as well as a method of making such fiber through rapid solidification techniques.

In patent application Ser. No. 290,547, supra, a melt of ferromagnetic material was contained in a crucible and a spinning wheel contacted molten ferromagnetic metal received in the crucible to form fibers. Although this system worked well, there were certain disadvantages. A problem arose in trying to achieve continuous fabrication of the ferromagnetic fibers. There are many methods disclosed for producing metallic fibers having a small cross section, see for example U.S. Pat. No. 3,812,901 issued May 28, 1974 to Stewart et al, which are quite similar to the technique described in U.S. patent application Ser. No. 290,547. Other investigators have attempted to fabricate such fibers by using a solid rod of metal that is contacted by a spinning wheel located below and at the lower end of the rod. See for example U.S. Pat. No. 4,523,626 issued to Masumoto et al June 18, 1985. This technique is referred to as a "pendant drop" melt wherein the metal at the tip of the rod is melted either by an electron beam or by an external flame. The pendant drop is accessed at the lower end thereof by a spinning wheel, and surface tension stabilizes the drop against gravity. Unfortunately, this type of method for producing metallic fibers has a number of drawbacks. In the electron beam melting, a high vacuum, between $1\times10^{-6}$ to $2\times10^{-6}$ torr is required. In the flame melting technique, severe oxidation can result. Alternate sources of "clean" heat which do not require a vacuum, such as radio frequency heating, are difficult to use in the pendant drop configuration because the additional forces resulting from the electromagnetic waves destabilize the drop. It should also be noted that these previous techniques did not succeed in forming fibers having a diameter of less than about 25μ.

SUMMARY OF THE INVENTION

The instant invention eliminates, or substantially reduces, the problems associated with prior melt extraction techniques. The material to be cast as a fiber is in the form of a rod which is brought into contact with a spinning wheel that is located above the rod. The rod is inductively heated by a specially designed, slightly curved spiral coil. The coil is shaped to focus the heat at, or close to, the tip of the rod and also to induce the melt to form a sharply rounded end by using the combination of electromagnetic forces, surface tension, and gravitation to stabilize the melt. The rod is fed through a loosely fitting guide that acts as a heat sink to carry away excess heat and prevent the rod from melting, except at its tip. The spinning wheel has a tapered perimeter that is placed in contact with the melted tip of the rod and extracts a portion of the melt from the molten tip to form a fiber. Preferably, the apparatus is enclosed in an inert gas environment to inhibit the formation of oxides on the fibers and the surface of the melt. Such oxides limit the quality of the fibers produced and the elimination of these oxides permits the casting of extremely fine fibers, i.e., fibers with a small cross section.

DETAILED DESCRIPTION OF THE PREFERRED EMBODIMENTS

Figure 1:
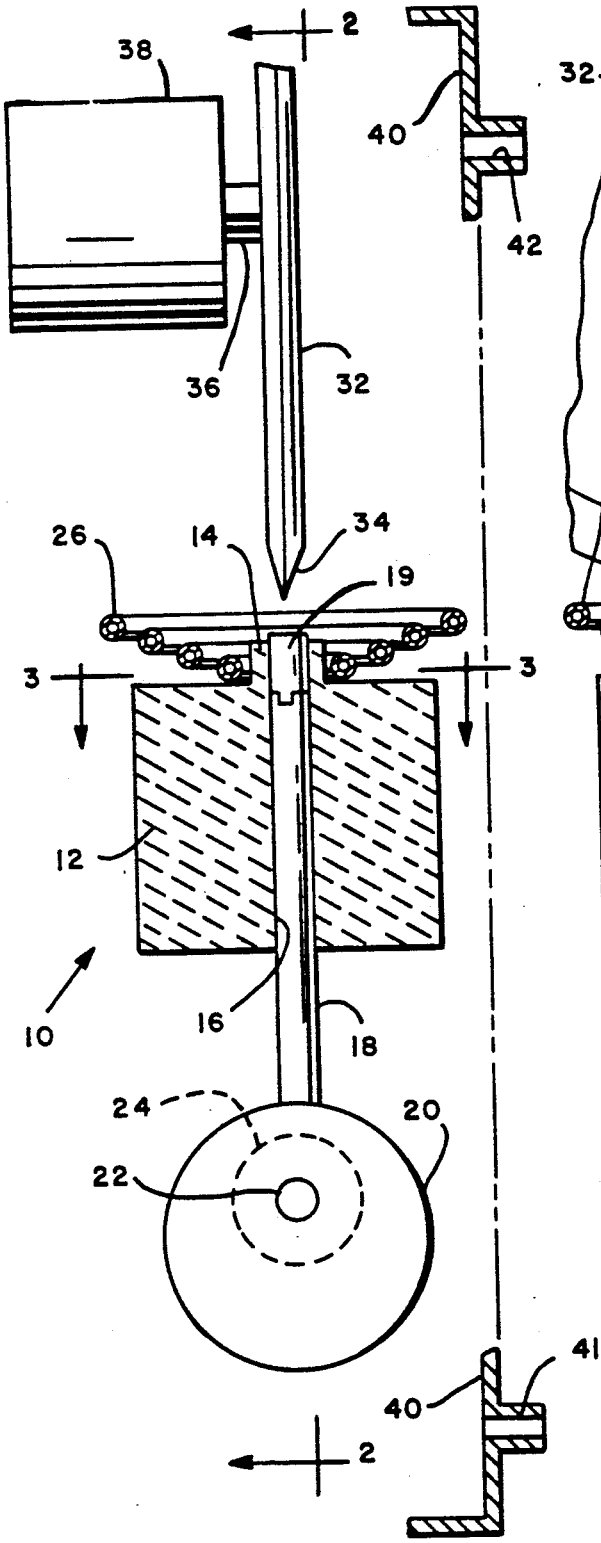
FIG. 1, is a general, cross sectional view of an apparatus capable of producing ferromagnetic fibers in accordance with the instant invention.
Figure 2:
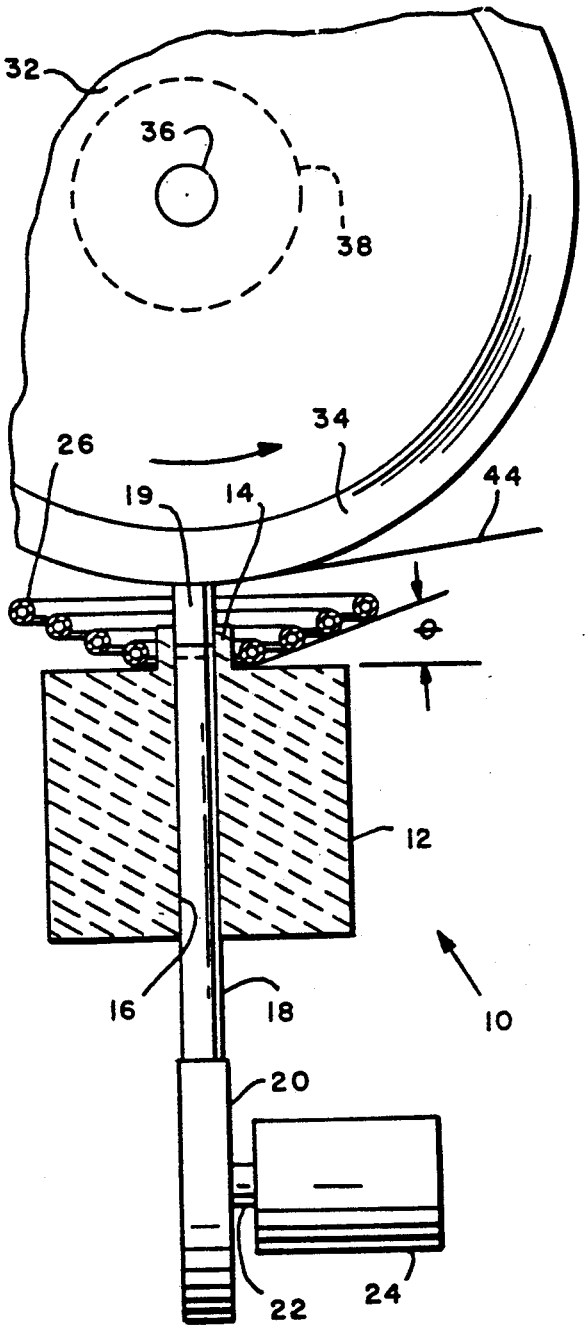
FIG. 2, is a view taken along the lines 2—2 of FIG. 1.
Figure 3:
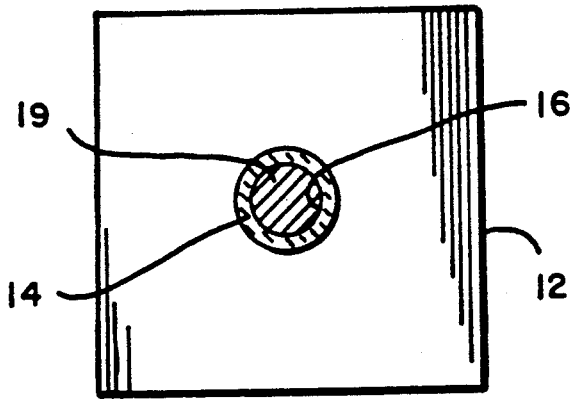
FIG. 3, is a view of the apparatus taken along the lines 3—3 of FIG. 1.
Figure 4:
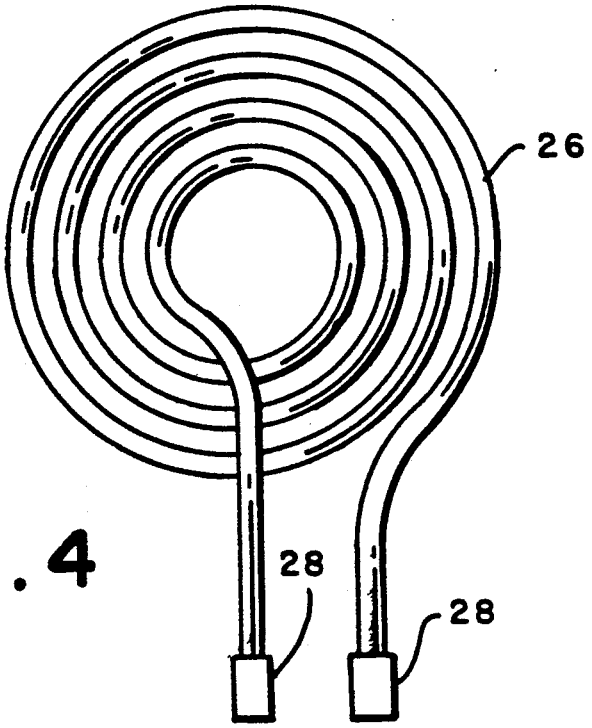
FIG. 4, is a plan view of the induction coil that is part of the apparatus shown in FIG. 1.

Referring now to the drawing, an apparatus for rapid quenching using the melt extraction technique is shown generally at 10 and includes a generally vertically oriented guide or sleeve 12 having a collar 14 integral with and located at the upper end thereof. The guide 12 has a longitudinally extending, vertical opening 16. The guide 12 is preferably made of a material having high thermal conductivity such as boron nitride. Other electrically insulating materials can be used so long as they have the criteria that the material is able to withstand high temperatures, i.e., in excess of 1500° C., have high thermal conductivity and not react with the material to be spun. A metallic rod 18, preferably made of a ferrous material, is received within the opening 16. The rod 18 has a greater length than the opening 16 and its axis is proximately coaxial with the axis of the opening. Alternatively, the rod 18 can be made of a material different than that to be spun and a tip 19 may be attached to the upper end of the rod. The attachment could be tongue and groove, as shown, threaded or any other convenient manner. Of course, the tip 19 would be made of the material to be spun.

A mechanism is provided for the selective lifting of the rod 18 and this mechanism may take the form of a cam 20 that is fixedly supported upon a shaft 22, the shaft 22 having a handle or pulley 24 at one end thereof for the purpose of rotating the shaft. It will be appreciated that this is only an example of a mechanism for driving the rod 18 and any other convenient manner can be used. The criteria is that the movement of the rod be controlled so as to correspond to the material being consumed during the fabrication of the fiber 44.

A coil 26 is supported by and disposed about the collar 14 with the elements of the coil forming an angle relative to the top of the guide 12, the angle being greater than 0° but less than 45°, preferably between 20° and 35° relative to the horizontal plane of the guide 12. The coil 26 contains terminals 28 at the ends thereof for the purpose of providing connection to a power source (not shown).

Located above the collar 12 and in proximate alignment with the axis of the rod 18 is a wheel 32, preferably made of a material having high thermal conductivity, high hardness and the ability to hold a sharp edge, such as molybdenum, which has a tapered cross section that forms a relatively sharp apex 34 at the region of the circumference with a radius of curvature of approximately 30 microns. This curvature would be selected based upon the material to be spun and the sought after cross section of the fibers. The wheel is fixedly supported by a shaft 36 that has motor 38 located at one end thereof. The motor 38 is provided to rotate the shaft, and thus the wheel 32, at any desirable speed but it has been found preferable to have the wheel of the instant invention have a targeted rotation of 4 meters/sec to 80 meters/sec. Preferably, the apparatus is enclosed in a gas tight housing 40 having an inlet 41 and outlet 42 whereby an inert or protective atmosphere can be introduced so as to prevent oxidation. Even though use of a housing 40 is preferred, it has been found that the instant process produces less oxidation of the fiber 44 then do other prior processes.

In the reduction to practice of the instant invention, the guide 12 was rectangular in configuration with the upper surface being 24.4mm long. The opening 16 had a diameter of 6.5 mm. Although the opening is shown as being vertical, it can be at an angle of up to 30°. The guide 12 was made of boron-nitride. The coil was made of ⅛" thin wall tubing with an opening of 1/10" for the flow of cooling water therein. The wheel 32 had a diameter of 50 mm and the radial length of the tapered portion was 8 mm. The collar 14 had an outside diameter of 11 mm and was 2.25 mm thick and 5 mm high.

The coil 26 is formed at an angle between 20° and 35° to concentrate the energy of the induction field at the tip of the rod 18 and provide optimal configuration of the inductive field for the stabilization, positioning and shape of the meniscus formed.

The rod 18 can be made of any material susceptible to being heated by an induction coil. Preferably, the rod 18 is made of a ferrous metal, but other materials such as Al, Zn, Ti and the like can be used. An example of a ferrous material that was cast into a fiber is one made of 35 to 85 atomic percent iron or cobalt or a combination thereof with up to 55 atomic percent nickel, up to 2.5 atomic percent either chromium or molybdenum, 12 to 20.3 atomic percent either boron or phosphorous, up to 13 atomic percent silicon and up to 2 percent carbon.

The wheel 32 is spun by enabling the motor 38. In the reduction to practice with the equipment described, the wheel was spun between 1500 rpm and 3000 rpm depending upon the sought after fiber cross section. Power is supplied to the induction coil so as to melt that portion of the rod 18 that is located within the coil 26. The rod 18 was slowly but continuously fed from the bottom by rotation of the shaft 22 thereby causing the cam 20 to lift the rod 18. The rate of feed controls, within limits, the diameter of the fiber to be produced, a slow feed producing fine fiber and fast feed producing a relatively thick fiber. If the rate of feed is too fast, the process is limited by the maximum extraction rate of the wheel 32, any excess being displaced off the tip, solidifying and frequently bringing the extraction process to a halt. If the rate of feed of the rod 18 is too slow , the process is limited by vibration of the meniscus which prevents fiber from being formed. In the reduction to practice, one rate of feed that was found satisfactory was 0.2 cm/min for a rod of ¼" diameter. Once a satisfactory feed rate is determined empirically, the system can be left to operate automatically. To ensure continued high quality of ferromagnetic fibers, the wheel should be cleaned from time to time during processing. This can be accomplished by wiping the wheel 32 with a clean cloth or brush. It should be noted that the wheel is not hot because of its large size relative to the small contact with the molten metal.

The novel features of the instant invention are:

1. Continuous casting by a crucible free method where the molten material is supported by the same material in the solid state.

2. Use of a ceramic guide to facilitate the feeding of the rod and the carrying away of excess heat.

3. Semi-automatic casting of fibers of constant diameter by uniform feed.

4. The use an induction coil to focus the heat and stabilize the molten meniscus and making a meniscus with a narrow tip.

5. Casting of high strength fibers. A 10 mm fiber has been cast with a yield strength of 1000 kg/mm$^2$. It will be appreciated this is a yield strength beyond the range of virtually all materials. This can be compared to carbon fibers that have a yield strength no greater than 200 kg/mm$^2$.

Although the fiber of the instant inventor has been describe generally as useful in the EAS field, there are other uses as well. The fibers can be used as reinforcement for concretes, polymers, plasters and the like, can be used for re-enforcing iron rods and will not corrode, and the fibers can be used in ceramics to yield ceramics with high electrical conductivity, thermal conductivity and with high mechanical strength and magnetic properties.

Thus, what has been shown and described is an apparatus and method whereby metallic fibers may be fabricated, which fibers have small cross sectional area with high strength.

What is claimed is:

1. Apparatus for fabricating metallic fibers having a small cross section, comprising:

a guide having a generally vertical, longitudinal opening extending therethrough, an induction coil located at the upper end of said guide with the center of the turns of said coil being proximately coaxial with the axis of said opening, a wheel having a tapered portion around the perimeter thereof, said tapered portion of said wheel being in general alignment with the axis of said opening, and means for rotating said wheel.

2. The apparatus of claim 1, including means for moving a rod vertically upwardly through said opening and into contact with said wheel.

3. The apparatus of claim 2 wherein said rod is formed from a ferromagnetic metal.

4. The apparatus of claim 2 wherein said rod is made of two materials, one of said materials being ferromagnetic metal, said ferromagnetic metal portion of said rod being received within said induction coil.

5. The apparatus of claim 1, wherein said guide is made from boron nitride.

6. The apparatus of claim 1, wherein the turns of said induction coil form an angle relative to the horizontal of 20° to 35°.

7. The apparatus of claim 6, wherein said angle is less than 45°.

8. The apparatus of claim 1, wherein said wheel is made of a material having a high hardness, high thermal conductivity and is able to hold a sharp edge.

9. The apparatus of claim 7, wherein said edge has a radius of curvature of approximately 30 microns.

10. The apparatus of claim 8, wherein said material is molybdenum.

11. The apparatus of claim 1, wherein said guide has a collar at the top thereof that is coaxial with said generally vertical opening.

12. A method for fabricating metallic fibers having small cross section, comprising:

a. providing a guide having therein a generally vertically extending longitudinal opening, b. placing an induction coil at the upper end of the guide with the center of the coil being proximately coaxially with the axis of said opening, c. locating a wheel having a tapered portion about the perimeter thereof in alignment with the axis of said opening, d. placing a metallic rod within said guide opening with one end of the rod being received within the turns of the coil and, e providing power to the induction coil so as to cause the tip of the rod to melt rotating said wheel, and moving said rod towards said wheel.

13. The method of claim 12 including placing a ferromagnetic rod with said guide opening.

14. The method of claim 13 including controlling the speed of rotation of said wheel to form a fiber.

15. A method for fabricating metallic materials having a small cross section, the steps comprising:

a. movably supporting a rod in a generally vertical position, b. heating the upper tip of the rod to a temperature where it become molten and, c. engaging the molten tip of the rod with a rotating wheel.

16. The method of claim 15 including the step of removing heat from the rod except at the vicinity of its upper tip.

* * * * *